US010612543B2

(12) United States Patent
Morselli

(10) Patent No.: US 10,612,543 B2
(45) Date of Patent: Apr. 7, 2020

(54) GEARED POSITIVE-DISPLACEMENT MACHINE WITH INTEGRAL ROLLING TRACKS FOR THE ROLLING BODIES

(71) Applicant: Settima Meccanica S.r.l., San Giorgio Piacentino (IT)

(72) Inventor: Mario Antonio Morselli, Modena (IT)

(73) Assignee: SETTIMA MECCANICA S.R.L., Giorgio Piacentino (Piacenza) (IT)

( * ) Notice: Subject to any disclaimer, the term of this patent is extended or adjusted under 35 U.S.C. 154(b) by 290 days.

(21) Appl. No.: 15/563,492

(22) PCT Filed: Mar. 31, 2016

(86) PCT No.: PCT/IB2016/051849
§ 371 (c)(1),
(2) Date: Sep. 29, 2017

(87) PCT Pub. No.: WO2016/157126
PCT Pub. Date: Oct. 6, 2016

(65) Prior Publication Data

US 2019/0032654 A1 Jan. 31, 2019

(30) Foreign Application Priority Data

Apr. 1, 2015 (IT) ..... 102015000010656

(51) Int. Cl.
*F04C 2/16* (2006.01)
*F04C 15/00* (2006.01)

(52) U.S. Cl.
CPC ..... *F04C 2/16* (2013.01); *F04C 15/0026* (2013.01); *F04C 15/0042* (2013.01); *F04C 2240/50* (2013.01)

(58) Field of Classification Search
CPC .... F04C 15/0026; F04C 2240/50; F04C 2/16; F16C 19/26; F16C 2360/00
See application file for complete search history.

(56) References Cited

U.S. PATENT DOCUMENTS 2,487,732 A * 11/1949 Schanzlin ..... F04C 15/0026 417/283
3,291,053 A * 12/1966 Gordon ..... F04C 15/0042 418/132
9,068,456 B2 * 6/2015 Yarr ..... F01C 1/103

* cited by examiner

*Primary Examiner* — Mary Davis
(74) *Attorney, Agent, or Firm* — Hickman Palermo Becker Bingham LLP

(57) ABSTRACT

A geared positive-displacement machine (10), comprising a housing (11) provided with a suction port and with a discharge port, a pair of gearwheels (14, 15) that are housed and supported by respective shafts (16, 18) for the rotation in a space inside the housing (11) and in fluid communication with the suction port and the discharge port, wherein the gearwheels (14, 15) mesh with each other and have parallel or coinciding axes and a first wheel (14) thereof is driving and a second wheel (15) is driven, a pair of containment bodies (19, 20) for axially containing the wheels (14, 15), said containment bodies (19, 20) being associated with the housing (11) and each comprise a first face (19*a*, 20*a*) that faces the pair of gearwheels (14, 15) and a second face (19*b*, 20*b*) that is axially opposite with respect to the first face (19*a*, 20*a*), and, for each of the two wheels (14, 15), a plurality of rolling bodies (21) that form a crown and that are freely housed in an annular seat (22) that is coaxial to the respective shaft (16, 18) and that is defined at the interface between the first face (19*a*, 20*a*) of at least one of the two containment bodies (19, 20) and the surface (14*a*, 15*a*; 14*b*, 15*b*) of the wheels (14, 15) that in turn faces it, respectively in the first face (19*a*, 20*a*) of at least one of the two containment bodies or in the surface (14*a*, 15*a*; 14*b*, 15*b*) of the gearwheels facing the first face (19*a*, 20*a*), wherein the rolling bodies (21) rest on rolling tracks (23, 24) respectively integral with the wheels (14, 15) and with the at least one containment body (19, 20). Between the first face (19*a*, 20*a*) of the at least one containment body (19, 20) and the surface (14*a*, 15*a*; 14*b*, 15*b*) of the wheels (14, 15) facing the first face a distance (D) greater than zero exists.

20 Claims, 6 Drawing Sheets

GEARED POSITIVE-DISPLACEMENT MACHINE WITH INTEGRAL ROLLING TRACKS FOR THE ROLLING BODIES

This application is a US national stage application filed under 35 U.S.C. § 371 based upon International Patent Application PCT/IB2016/051849, filed 31 Mar. 2016, which claims the benefit of Italian application 102015000010656, filed 1 Apr. 2015, the entire contents of which are hereby incorporated by reference as if fully set forth herein for all purposes.

The present invention refers to a geared positive-displacement machine.

In particular, the present invention refers to an external geared positive-displacement machine.

Even more specifically, the present invention refers to an external geared positive-displacement machine having "compensated axial clearance" or "balanced".

Specifically, the present invention refers to an external geared positive-displacement pump having axial clearance preferably "compensated" or "balanced" for high pressures, i.e. for pressures of the order of 100-300 bar.

External geared positive-displacement pumps, as known, comprise a housing provided with a suction port and with a discharge port and inside which a pair of mutually meshed gearwheels is housed: a first gearwheel (pinion) is mounted on a first shaft that takes the motion from a prime motor and a second gearwheel is mounted on a second shaft, which is parallel to the first shaft, and is driven by the first gearwheel.

The rotation of the two gearwheels transports the liquid sucked and trapped between two consecutive teeth of each of the two gearwheels and the walls of the housing from the suction port to the delivery port; the meshing between the teeth of the two gearwheels prevents the liquid from flowing back towards the suction port.

The radial and axial clearances between the pair of gearwheels, the relative bearings and the housing must be reduced in order to ensure the seal of the liquid between the suction port and the delivery port, both in the radial direction and in the axial direction. The volumetric efficiency of such pumps, in fact, is quickly reduced if the seal of the liquid is not good.

Constructively, external geared pumps, i.e. with external toothing, can be of the type with "fixed axial clearance" or with "compensated axial clearance" or "balanced".

In external geared pumps with "compensated axial clearance" the two gearwheels, or rather their shafts, are supported by a pair of lateral bearings that are housed in the housing in an axially movable manner and that are known in the jargon as "floating bushes" or "floating sidewalls".

On the outer faces of the bearings, i.e. on the faces of the bearings facing towards the closing covers of the housing and opposite those facing the pair of gearwheels, gaskets are arranged that delimit two surfaces, on one of which the delivery pressure acts during use.

The areas of the two surfaces delimited by the gaskets are calculated and proportioned so that, in use, balancing axial thrusts are generated that bring the bearings ("floating bushes") close to the pair of gearwheels ensuring a minimum and substantially constant lateral clearance, compensating the thrust on the bearings due to the pressurised liquid in the chamber in which the gears rotate.

An example of an external geared positive-displacement machine with compensated axial clearance is described in EP1291526.

However, during operation the rotation of the gearwheels causes a periodic variation of the area of the inner faces of the bearings (i.e. of the faces of the bearings facing the gearwheels) on which the delivery pressure acts. This periodic variation generates oscillations of the axial loads that act on the bearings and that need to be balanced. This contributes increasing the typical noisiness of such pumps and reducing the overall efficiency. This oscillation of the axial loads is, generally, limited and tolerated in pumps having spur cylindrical gearwheels, whereas it is, generally, substantial in pumps having cylindrical gearwheels with helical teeth. During the operation of these last pumps, in fact, the meshing between the gearwheels is the cause of a periodic variation of the axial loads both mechanical and hydraulic. In order to avoid this phenomenon, the balancing is sized so as to generate an overall balancing axial thrust that on average is oversized with respect to the maximum axial load peaks to be counteracted. This is due to overloads, wear and losses of mechanical and hydraulic efficiency.

In these known pumps, moreover, between the inner faces of the bearings and the facing faces of the two gearwheels a hydrodynamic film or meatus forms consisting of the liquid that is pumped, usually, but not necessarily, hydraulic oil. However, in order to form and maintain a film or meatus that is substantially stable and of sufficient height to limit the sliding friction between the inner faces of the bearings and the gearwheels, it is necessary for the gearwheels to rotate at a speed greater than or equal to a minimum speed that, generally, is equal to 600÷800 revs/min. Pumps of this kind, therefore, are not suited for operating at high pressures (for example of the order of 100 bar up to 250 bar and over) and at low speeds (like for example speeds of the order of 100-500 r.p.m.), since in such conditions the hydrodynamic film or meatus loses load bearing capacity, i.e. becomes thinner to such a point as to allow direct contact of the crests of the roughness of the surfaces of the gearwheels and of the surfaces of the bearings facing them with consequent stress peaks due to sliding friction.

This drawback is particularly severe in the case in which the overall balancing axial thrust is oversized on average with respect to the maximum axial load peaks to be counteracted and/or in the case in which the liquid that is pumped has poor lubricating characteristics.

In order to limit the wearing by sliding friction of the inner faces of the bearings and of the facing surfaces of the gearwheels it is known to make such surfaces with particularly low surface roughness with mechanical machining and/or chemical finishing and polishing treatments or to adopt special shape provisions like, for example, bevelling or removal of material from the teeth of the gearwheels as described for example in WO2014/147440.

The purpose of the present invention is to avoid the drawbacks of the prior art.

In this general purpose, a particular purpose of the present invention is to propose a geared positive-displacement machine that can also operate at high pressures (like for example pressures of the order of 100-300 bar) and at low speeds (like for example speeds of the order of 100-500 r.p.m.), ensuring the seal of the liquid.

Yet another purpose of the present invention is to propose a geared positive-displacement machine that allows limiting wear by sliding friction between the gearwheels and the respective bearings due to the contact between the surfaces of the wheels and the lateral bearings by breaking of the hydrodynamic film or meatus.

A yet further purpose of the present invention is to propose a geared positive-displacement machine that is particularly simple and functional, with low costs.

These purposes according to the present invention are accomplished by making a geared positive-displacement machine as outlined in claim 1.

Further characteristics are provided in the dependent claims.

The characteristics and advantages of a geared positive-displacement machine according to the present invention will become clearer from the following description, given as an example and not for limiting purposes, referring to the attached schematic drawings, in which.

Figure 1:
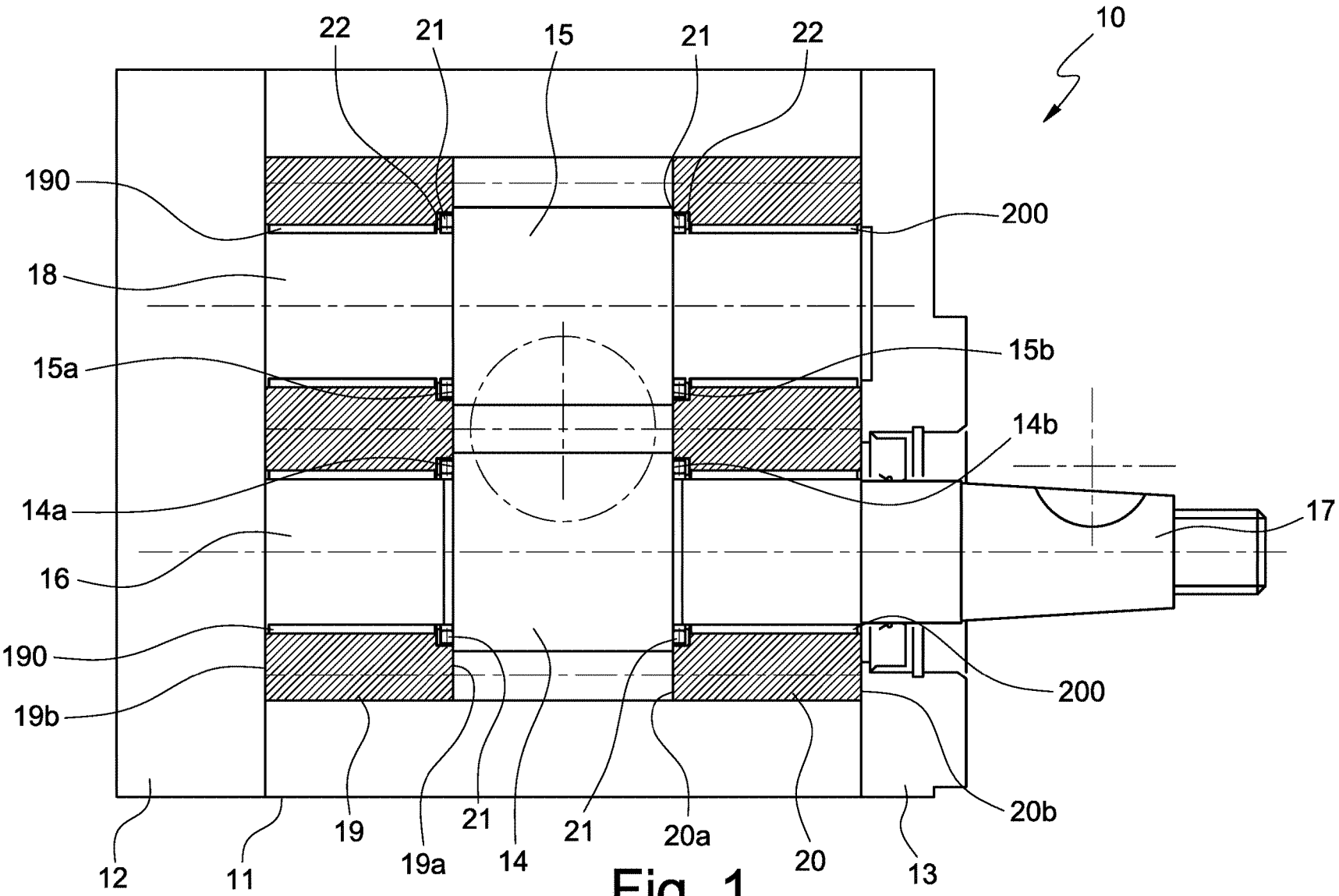
FIG. 1 is a longitudinal section view of a possible embodiment of the geared positive-displacement machine according to the present invention.
Figure 2:
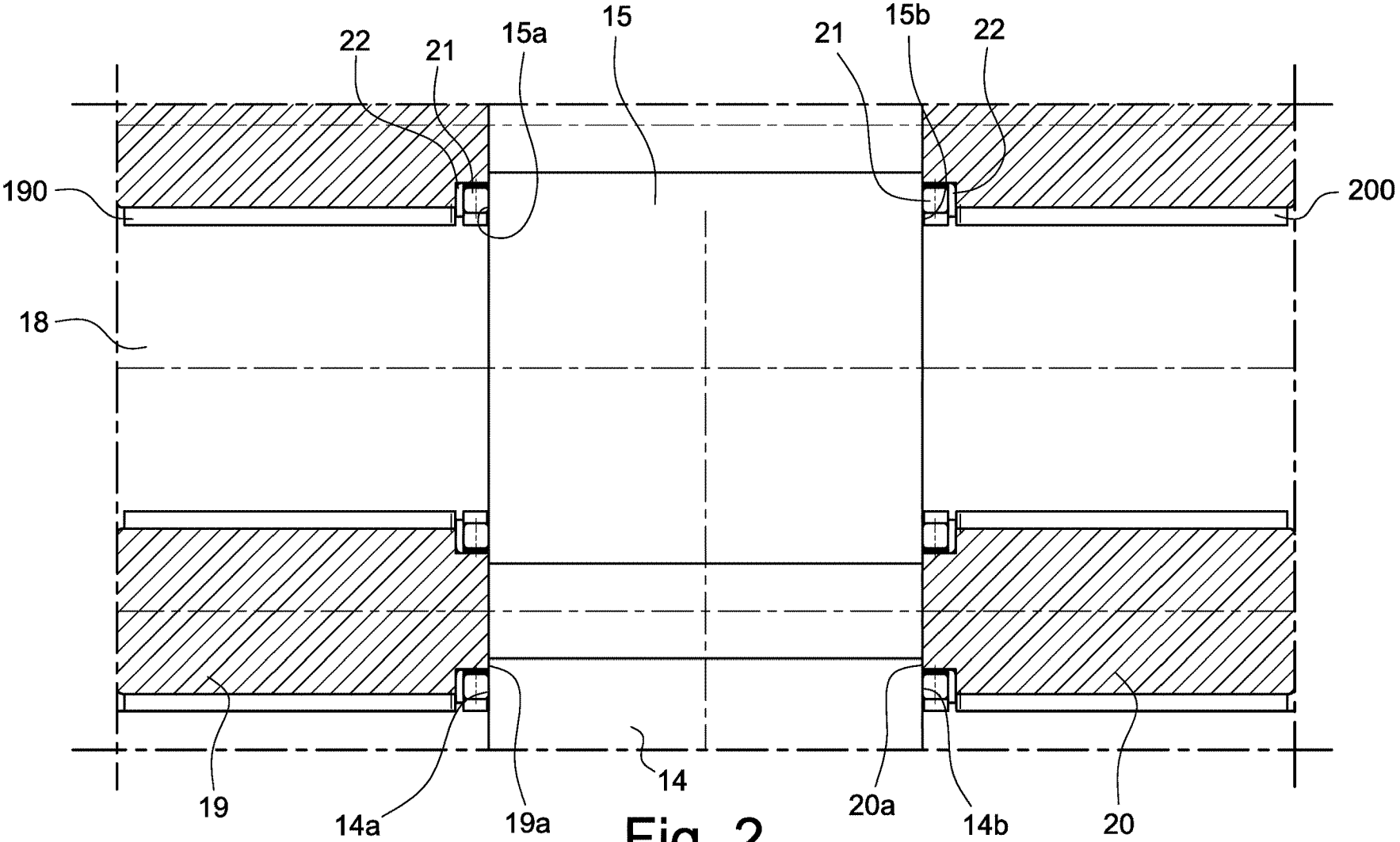
FIG. 2 shows a detail of FIG. 1 with a larger scale.

With reference to the attached figures, a geared positive-displacement machine is shown wholly indicated with reference numeral 10.

In a preferred embodiment, the machine 10 is of the external geared type, i.e. with external toothing.

In particular, the machine 10 is of the pump type.

The machine 10, in a known way, comprises a housing 11 provided with a suction port and with a discharge port, which are not shown in the attached figures since they are of the type known to the skilled in the art.

The housing 11 consists of a generally cylindrical tubular body that is open at the opposite ends, at each of which a respective cover 12 and 13 is removably fixed.

Inside the housing 11 a space is defined that is in fluid communication with the suction port and with the discharge port.

Inside such a space a pair of mutually meshed gearwheels having parallel axes is housed, each of which is supported for rotation by a respective shaft.

In greater detail, the pair of gearwheels comprises a first wheel 14 that drives and that meshes with a second wheel 15 that is driven.

The first wheel 14 is mounted on a respective first shaft 16 at one end of which a tang 17 is obtained that projects out of the housing 11 for the connection (in the case in which the machine 10 is a pump) with a prime motor, not shown since it is of the type known to the skilled in the art.

The second gearwheel 15 is in turn mounted on a respective second shaft 18 parallel to the first shaft 16.

The first gearwheel 14 and the second gearwheel 15 are respectively mounted on the first shaft 16 and second shaft 18 so as to make a complete connection with it.

It is specified that in the present description the use of adjectives such as "first" and "second" is made just for the sake of clarity and must not be taken in the limiting sense; in the rest of the description, moreover, the expressions "first wheel 14" and "wheel 14", "second wheel 15" and "wheel 15", "first shaft 16" and "shaft 16", "second shaft 17" and "shaft 17" will be used without distinction.

The machine 10 also comprises a pair of containment bodies 19 and 20, otherwise indicated as sidewalls, rings, bushes or, in the jargon, "shims", for axially containing (laterally) the two wheels 14 and 15. The two containment bodies 19 and 20 are associated with the housing 11 and each comprise a first face, 19*a* and 20*a* respectively, which faces (i.e. directly facing) the pair of gearwheels and a second face, 19*b* and 20*b* respectively, that is axially opposite with respect to the first face 19*a* and 20*a*.

The first face 19*a*, 20*a* of the two containment bodies 19, 20, in other words, faces towards the inside of the space in which the two wheels 14 and 15 are housed, whereas the second face 19*b*, 20*b* thereof faces towards the outside such a space.

With particular reference to the embodiment represented in the attached figures, the two containment bodies 19 and 20 are housed in the space inside the housing 11 and are arranged between the two covers 12 and 13.

In a preferred embodiment, like for example the one shown in the attached figures, in each of the two containment bodies 19 and 20 respective pairs of bearings 190 and 200 or support seats for radially supporting the axially opposite ends of each of the two shafts 16 and 18 are also obtained.

The containment bodies 19 and 20, in general, have the function of ensuring the seal of the liquid in the axial direction and of housing the radial support bushes of the shafts of the gearwheels.

However, this does not rule out alternative embodiments in which, for example, the bearings for the radial support of the two shafts 16 and 18 are obtained in bodies different from the containment bodies 19 and 20 and in any case associated with or housed in the housing 11.

In a further preferred embodiment, moreover, the machine 10 is of the type with "compensated axial clearance" or "balanced" through axial balancing of the "shims" 19 and 20 for the axial containment of the gearwheels, as known in the manufacturing field of these pumps. In this case, the two containment bodies 19 and 20 are housed in an axially mobile manner inside the housing 11 and, when the machine 10 is in use, on at least one portion of the second face 19*b* and 20*b* of at least one of them, the liquid—thanks, for example, to the provision of suitably shaped gaskets that are not shown since they are of the known type—acts at the delivery pressure to generate overall axial thrusts that bring the containment bodies 19 and 20 and the pair of gearwheels 14 and 15 close to one another. In this preferred embodiment, the two containment bodies 19 and 20 are of the so-called "floating sidewalls" or "floating bush" type.

An example in which the two containment bodies 19 and 20 are of the type with "compensated axial clearance" or "balanced" is described in EP1291526 both with reference to the prior art quoted therein, and with reference to the invention described therein.

However, this does not rule out alternative embodiments of the machine 10 with regard to the provisions used for the compensation of the clearances between gears and the lateral containment bodies thereof.

The housing 11, the covers 12 and 13, the pair of gearwheels 14 and 15 and the respective shafts 16 and 18 and the pair of containment bodies 19 and 20 are not described any further since they are of the type known to the skilled in the art.

According to the present invention, the machine 10 comprises, for each of the two wheels 14 and 15, a plurality of rolling bodies 21 that form a crown and that are freely housed in a respective annular seat 22 that is coaxial to the respective shaft 16 and 18 and that is defined at the interface between the first face 19*a* or 20*a* of at least one same containment body 19 or 20—preferably of each of them—and the surface, 14*a*, 15*a* or 14*b*, 15*b* respectively, of the two wheels 14 and 15 that faces (i.e. directly faces) the first face 19*a* or 20*a*.

The rolling bodies 21, in other words, can be provided at the interface between the two gearwheels 14 and 15 and one of the two containment bodies 19 and 20 or at the interface between the two gearwheels 14 and 15 and each of the two containment bodies 19 and 20. This last embodiment is the one represented in the attached figures.

With reference to the embodiment represented in the attached figures, each annular seat 22 is obtained at the first face 19*a* and 20*a* of the respective containment body 19 and 20. However, this does not rule out alternative embodiments, in which the annular seats are obtained, at least partially, respectively at the surfaces 14*a*, 15*a* and 14*b*, 15*b* of the two wheels 14 and 15 respectively facing the first face 19*a* and 20*a* of the containment bodies 19 and 20.

Figure 3:
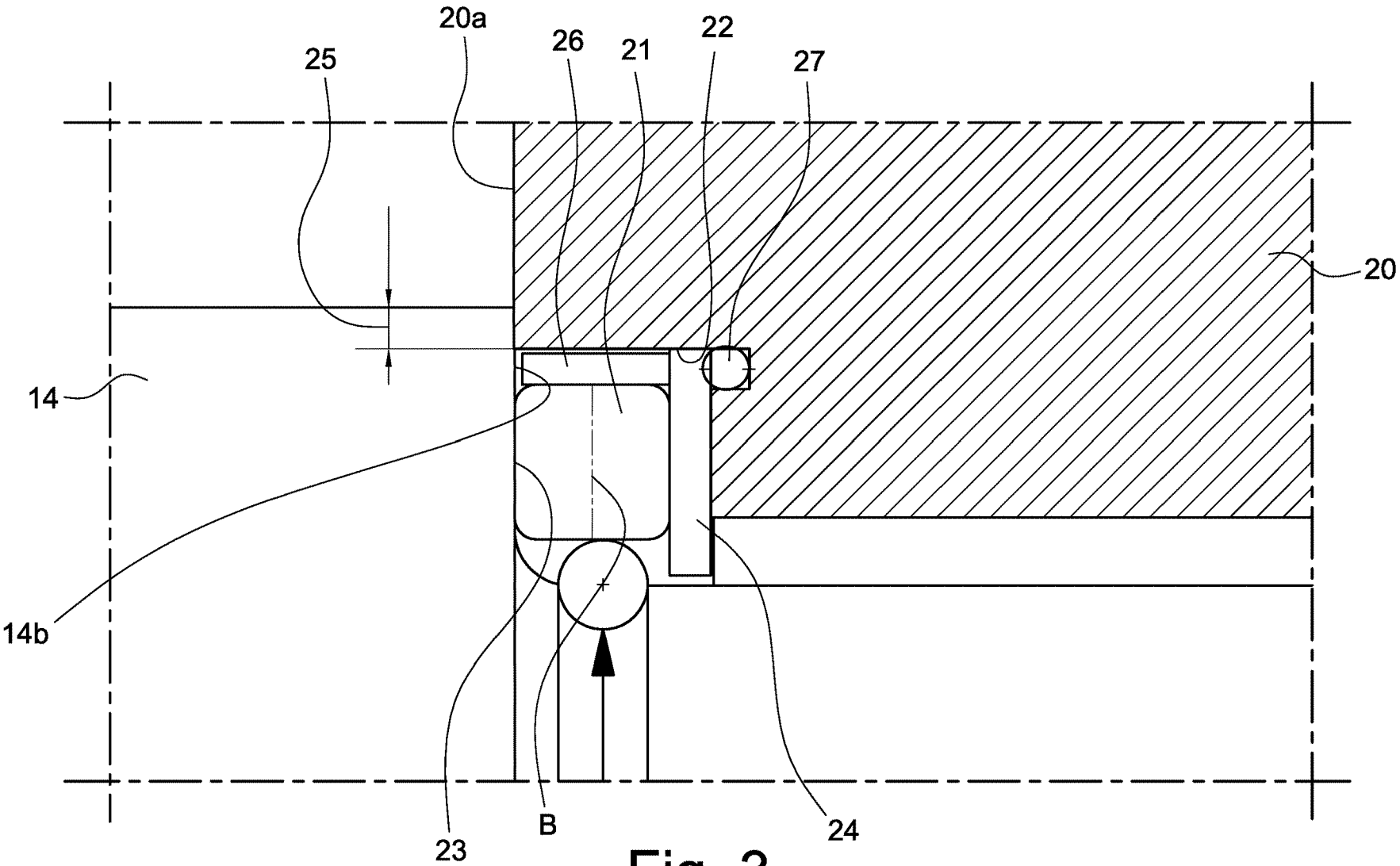
FIG. 3 shows a detail of FIG. 2 with a larger scale, illustrating a detail of an annular seat defined at the interface between one of the two containment bodies and one of the two gearwheels and in which rolling bodies are housed.
Figure 4:
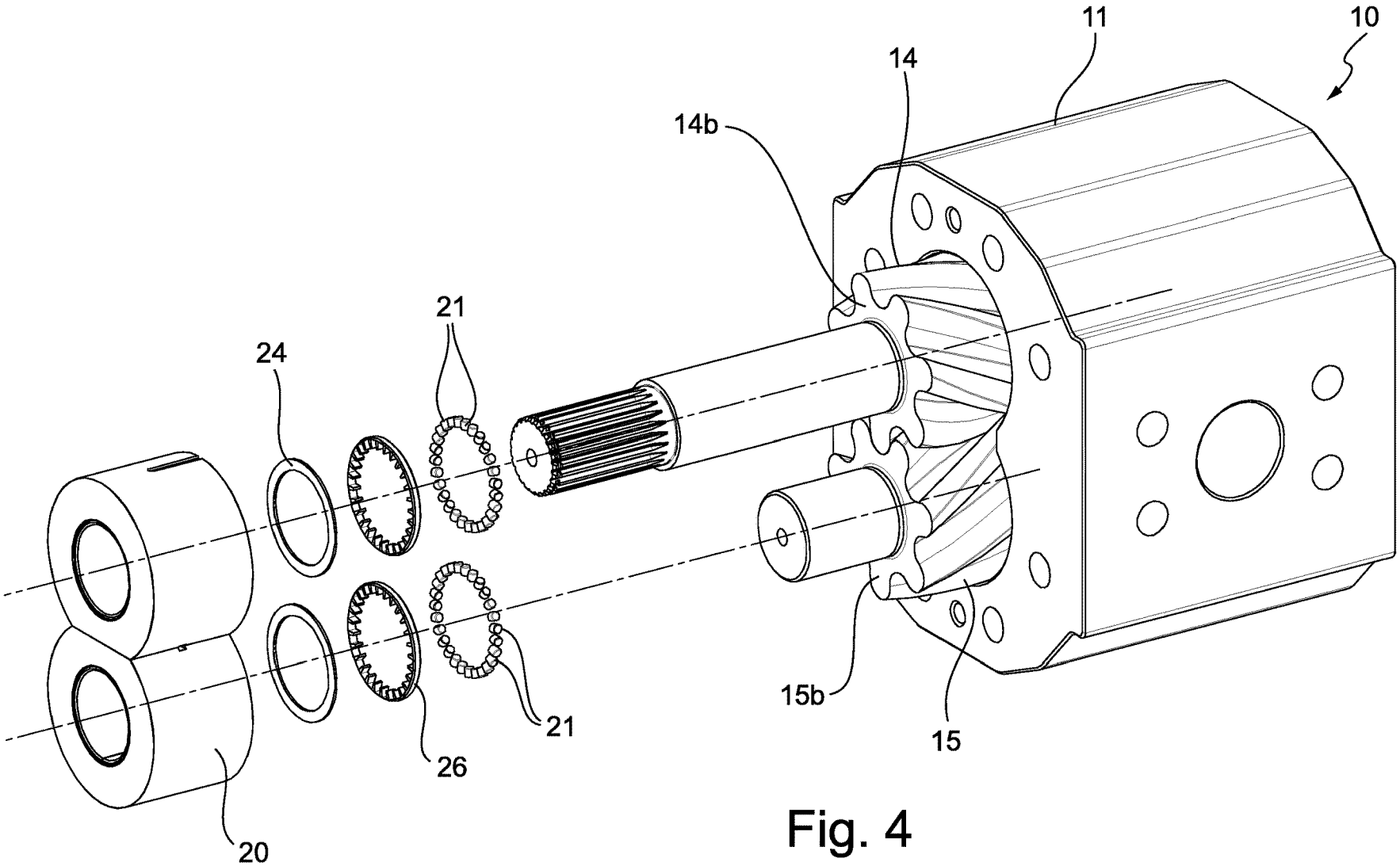
FIG. 4 shows an exploded view of a detail of a geared positive-displacement machine according to the present invention.

According to the present invention, the rolling bodies 21 rest on the relative rolling tracks that are integral with the wheels 14, 15 and with the containment bodies 19 and/or 20 when a distance D greater than zero exists between the first face 19*a*, 20*a* of the containment bodies 19 and/or 20 and the respective surface 14*a*, 15*a* and 14*b*, 15*b* of the two wheels 14 and 15 that faces it. In the attached FIGS. 3 and 4 the rolling tracks integral with the gearwheels 14, 15 are indicated with 23 and the rolling tracks integral with the containment bodies 19, 20 are indicated with 24.

The distance D, in general, is of the order of the thickness of the hydrodynamic film or meatus that, in operating conditions of the machine 10, is generated at the interfaces between the wheels 14, 15 and the containment bodies 19, 20 to support the axial thrusts.

Figure 3A:
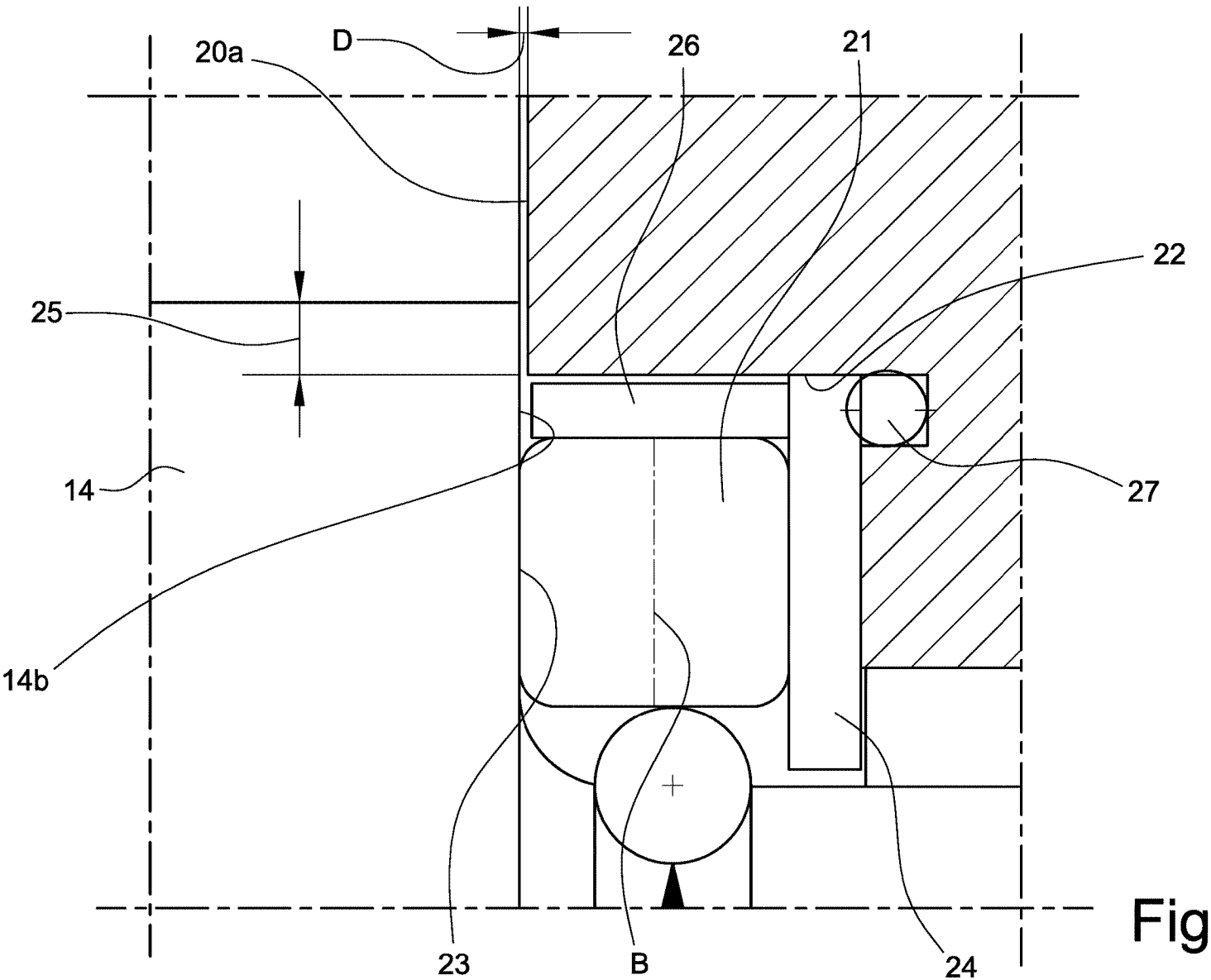
FIG. 3A shows a further enlargement of the detail of FIG. 3, in which the distance D between the mutually facing surfaces of the containment body and of the gearwheel has been exaggerated simply for illustrative purposes.

Considering the machine 10 in usual operating conditions, the distance D is in the order of minimum 1 micron and of maximum a few tens of microns, being able to reach the order of 100 microns for gearwheels having external diameter greater than 150 mm, which is why such a distance D cannot be seen in the attached figures and has been deliberately exaggerated in FIG. 3A solely for the sake of illustration.

With particular reference to the embodiment represented in the attached figures, in which the rolling bodies 21 are housed in a hollow annular seat obtained in the containment bodies 19, 20 and the rolling tracks respectively consist of continuous annular crowns of the gearwheels flat surfaces 14*a*, 15*a* and 14*b*, 15*b* facing the containment bodies 19, 20 and of the bottom of the annular seats 22, such a distance D transforms into a projection of the rolling bodies 21 from the respective annular seat 22. Concerning this, it is specified that the extent of the protrusion of the rolling bodies 21 with respect to the first surfaces 19*a*, 20*a* of the containment bodies 19, 20 measured "cold" in idle conditions of the machine 10 can also be substantially different from the distance D that is generated at the interface between the wheels 14, 15 and the containment bodies 19, 20 in operating conditions of the machine 10. In operating conditions, in fact, dilations and thermal deformations can modify conditions measured "cold".

It is specified that the distance D must be such as to not compromise the formation of a minimum continuous film or meatus so as not to compromise the seal of the liquid, which requires the existence of continuous surfaces facing one another at a minimum distance.

According to one aspect of the present invention, in fact, the crown of rolling bodies 21 or in any case the annular seat 22 that receives it is sized so that at the interface between the wheels 14, 15 and the respective containment body 19, 20 a shimming continuous annular crown 25 is defined that is useful for ensuring the seal of the liquid.

In other words, in operating conditions, at the shimming continuous annular crown 25 a continuous film or meatus of liquid is formed that is sufficiently thin to be useful to ensure the seal.

In greater detail and with reference to the embodiments represented in the attached figures, the crown of rolling bodies 21 or in any case the annular seat 22 has a smaller external diameter than the diameter of the root circle of the toothing of the respective gearwheel 14, 15 so that a shimming continuous annular crown 25 is defined between them (FIG. 3).

It is specified that, of course, in operating conditions of the machine 10 between the gearwheels 14, 15 and the containment bodies 19, 20 a film or meatus of fluid forms that is not limited to the shimming continuous annular crowns 25, but that, in general, also involves the toothings of the wheels 14, 15.

In operating conditions, according to the purposes of the invention, the axial abutment of the gearwheels 14, 15 on the containment bodies 19, 20 takes place on the rolling bodies 21 and on the meatus that overall forms between the wheels 14, 15 and the containment bodies 19, 20, with partition of the load on them dependent on the rotation speed of the wheels 14, 15.

As it is clear, in resting conditions of the rolling bodies 21 on the rolling tracks 23 and 24, between the surfaces 14*a*, 15*a* and 14*b*, 15*b* of the wheels 14, 15 and the facing first surfaces 19*a*, 20*a* of the containment bodies 19 and 20 there exists a distance D of the order of magnitude of the thickness of the meatus that is created in this interface and that, at normal operating speed of the machine 10, is adapted for supporting the axial thrusts to which the wheels 14, 15 are subjected, thus of the order of 1÷10 microns.

In practice, each crown of rolling bodies 21 defines an "axial bearing". When the machine 10 is in use, in fact, the rolling bodies 21 of each crown are adapted for supporting the axial thrusts that are generated between the pair of wheels 14 and 15 and the containment bodies 19 and 20 together with or as an alternative to the film or meatus of fluid that is generated at the interfaces between the first face 19*a*, 20*a* of the two containment bodies and the respective surfaces 14*a*, 15*a* and 14*b*, 15*b* of the two gearwheels 14 and 15 facing them.

In greater detail, each crown of rolling bodies 21 is arranged inside the root circle (circumference at the base of the teeth) of the toothing of the respective wheel 14 and 15.

Equally, the external diameter of each annular seat is smaller than the diameter of the root circle (circumference at the base of the teeth) of the toothing of the respective wheel 14 or 15.

Between each annular seat 22 and the root circle (or circumference at the base of the teeth) of the respective wheel 14 or 15 a shimming continuous annular crown 25 is thus defined at which a continuous hydrodynamic film or meatus for sealing the fluid forms, during the operation of the machine 10. Once again, it is specified that in operating conditions the hydrodynamic film or meatus forms not only at the shimming continuous annular crown 25, but also between the teeth of the wheels 14, 15 and the facing surfaces of the containment bodies 19, 20, and this hydrodynamic film or meatus as a whole contributes bearing the axial thrusts that are generated between the containment bodies 19 and 20 and the two wheels 14 and 15. The height in the radial direction of the shimming continuous annular crown 25 is of the order of a few millimetres, for example for wheels 14, 15 having external diameter of 70 mm it is 1-2 mm.

In the embodiment represented in FIGS. 1 to 4, such a continuous annular crown 25 is defined without solution of continuity between the external diameter of each annular seat 22 and the root circle of the toothing of the respective wheel 14 and 15.

In the embodiment represented in the attached figures, each annular seat 22 is obtained at the first face 19*a*, 20*a* of the respective containment body 19, 20 and is open at such a first face 19*a*, 20*a*. The rolling bodies 21 are held by a cage 26 arranged at the inner diameter of the respective annular seat 22 and rest on the bottom on which a rolling track 24 made of hard material is located, for example of the type used in the manufacturing of rolling bearings.

Between the rolling track 24 and the respective containment body 19, 20 an annular gasket 27 is arranged, housed in a respective groove.

The cage 26 is adapted for containing rolling bodies 21 to keep them in aligned and circumferentially spaced position, without mutual sliding, as provided by the current technique in making rolling bearings. This does not rule out the possibility of using "fully filling" spheres, i.e. without cage, which is possible for an axial bearing. In this case the rolling tracks can, advantageously, be toric recess shaped, in order to be able to have an advantageous osculation relationship in the contact with the spheres, as it is usual in the bearing technology.

The rolling bodies 21 can advantageously consist of rollers or needle rollers the axes of which B are arranged radially with respect to the respective shaft 16 and 18. In a possible alternative embodiment, the rolling bodies 21 can consist of spheres, however they have elastic yield greater than that of rollers or needle rollers for the same axial load.

The present invention is advantageously applicable to machines 10 in which the first gearwheel 14 and the second gearwheel 15 are cylindrical having external toothing with helical teeth.

In the embodiment represented in the attached figures, the machine 10 is of the pump type having "compensated axial clearance" or "balanced", in which the two containment bodies 19 and 20 are of the so-called "floating" type; advantageously, moreover, such two containment bodies 19 and 20 form bearings 190 and 200 for radially supporting the axially opposite ends of the two shafts 16 and 18.

For each of the two wheels 14 and 15, at the interface between the respective opposite side surfaces 14*a* and 14*b* and 15*a* and 15*b* and the first face 19*a* and 20*a* of the two containment bodies 19 and 20 respectively facing them, a corresponding annular seat 22 is defined containing a respective crown of rolling bodies 21 freely housed in it and as described above.

As already indicated above, the surface of the rolling bodies 21 rests on the rolling tracks 23 and 24, when, in operating conditions of the machine 10, between the first face 19*a*, 20*a* and the respective surface 14*a*, 15*a* and 14*b*, 15*b* of the two wheels 14 and 15 that faces it a distance D greater than zero exists.

During the operation of the machine 10, therefore, the axial loads that are generated between the two containment bodies 19 and 20 and the two wheels 14 and are supported, in whole or partially, by the hydrodynamic meatus that forms at the interfaces between the two wheels 14 and 15 and the containment bodies 19 and 20 and, in whole or partially, by the rolling bodies 21, as a function of the operative conditions. As the skilled in the art will immediately understand, the partition of such an axial load on the hydrodynamic meatus and the rolling bodies 21 depends, amongst other things, on the formation and stability conditions of the hydrodynamic meatus itself and on the yield of the rolling bodies 21, conditions which are in turn variable as a function, in particular, of the thermal dilation coefficient of the material from which the containment bodies 19 and 20 and the rolling bodies 21 are made, on the nature of the hydrodynamic meatus, on the friction coefficient between the two containment bodies and the two wheels, on the size of the wheels 14 and 15, on the rotation speed of the wheels 14 and 15, on the suction and delivery pressure, on the possible oversizing of the possible balancing thrust.

In general terms, when the machine 10 works at low rotation speeds of the two wheels 14 and 15, typically at a speed of the order of 600-800 revs/min and at high pressures, typically of the order of 100-250 bar and above, the hydrodynamic meatus loses stability and the axial load is totally or partially also supported by the rolling bodies 21.

Figure 5:
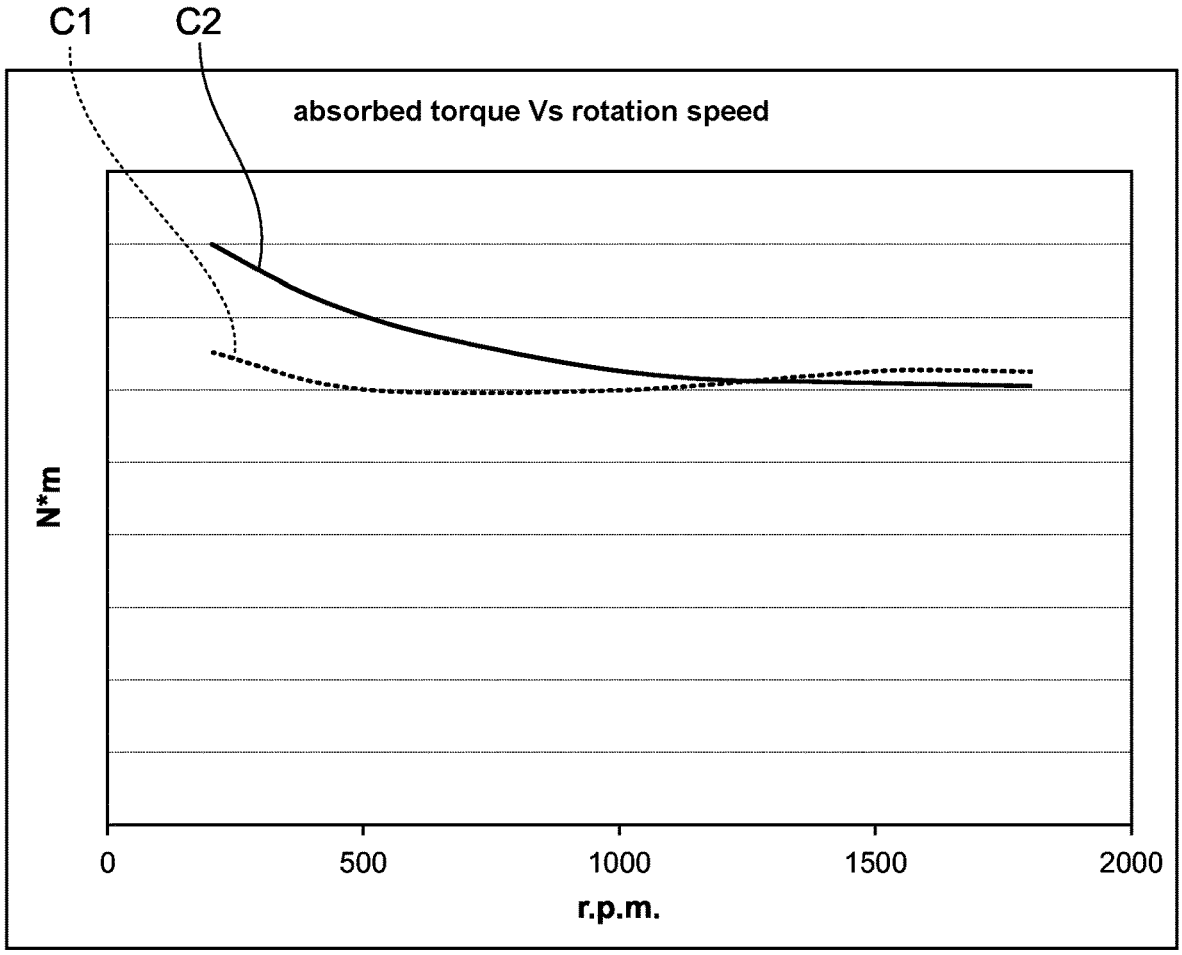
FIG. 5 is a diagram that comparatively shows the trend of the torque absorbed by a geared pump according to the present invention and by a geared pump according to the prior art as a function of the rotation speed.

In the diagram of FIG. 5 two curves C1 and C2 are displayed that show the trend of the torque absorbed by two pumps as a function of the rotation speed. The two curves C1 and C2 have been obtained by monitoring the absorption of a three-phase asynchronous electric motor, and refer to two pumps with identical construction, toothing and displacement, except for the adoption of the present invention with crowns of rolling bodies having needle rollers. The curve C1 is the one referring to the pump incorporating the present invention and it is noted that, at low speeds, such a curve is substantially spaced from the curve C2, showing precisely in these conditions how the friction generated on the shims decreases.

The geared positive-displacement machine object of the present invention has the advantage of allowing a substantial reduction of the sliding friction that is generated between the containment bodies and the gearwheels in particular in operating conditions at low rotation speeds of the two wheels, in any case generating the seal of the liquid and reliable operation of the pump, in particular avoiding excessive wear of the axial shim.

The geared positive-displacement machine thus conceived can undergo numerous modifications and variants, all of which are covered by the invention; moreover, the details can be replaced by technically equivalent elements. In practice, the materials used, as well as the sizes, can be whatever according to the technical requirements.

The invention claimed is:

1. A geared positive-displacement machine, comprising:

a housing provided with a suction port and with a discharge port;

a pair of gearwheels which are housed and supported by respective shafts for the rotation in a space inside the housing and in fluid communication with the suction port and the discharge port, the pair of gearwheels comprising a first gearwheel and a second gearwheel, wherein the first gearwheel and second gearwheel mesh with each other and are provided with parallel axes, and wherein the first gearwheel is driving and the second gearwheel is driven; and a pair of containment bodies for axially containing the pair of gearwheels, the containment bodies being associated with the housing and each comprising a first face which faces the pair of gearwheels and a second face which is axially opposite to the first face, wherein, for each of the first gearwheel and second gearwheel, the geared positive-displacement machine comprises a plurality of rolling bodies which form a crown and which are freely housed in an annular seat that is coaxial to the respective shaft and that is defined at the interface between the first face of at least one of the containment bodies and the surface of the first gearwheel or second gearwheel facing it, respectively in the first face of at least one of the containment bodies or in the surface of the pair of gearwheels facing the first face, wherein the rolling bodies rest on rolling tracks respectively integral with the pair of gearwheels and with the at least one containment body, when between the first face of the at least one containment body and the surface of the pair of gearwheels facing the first face a distance greater than zero exists.

2. The geared positive-displacement machine according to claim 1, wherein the rolling bodies, when the geared positive-displacement machine is in the operating conditions, are for supporting axial thrusts which generate between the pair of gearwheels and the at least one containment body.

3. The geared positive-displacement machine according to claim 1, wherein the distance is in the order of the thickness of the hydrodynamic film or meatus of liquid which generates at the interface and which supports the axial thrusts during the operation of the geared positive-displacement machine.

4. The geared positive-displacement machine according to claim 1, wherein the distance is of the order of minimum 1 micron and of maximum some tens of microns, up to a maximum of 100 microns.

5. The geared positive-displacement machine according to claim 4, wherein the distance is comprised between 1 micron and 60 microns.

6. The geared positive-displacement machine according to claim 4, wherein the distance is comprised between 1 micron and 30 microns.

7. The geared positive-displacement machine according to claim 4, wherein the distance is comprised between 1 micron and 10 microns.

8. The geared positive-displacement machine according to claim 1, wherein between the annular seat or between the crown of rolling bodies and the root circle of the toothing of the respective first gearwheel or second gearwheel a shimming continuous annular crown is defined.

9. The geared positive-displacement machine according to claim 8, wherein the external diameter of the annular seat is less than the diameter of the root circle of the toothing of the respective the first gearwheel or second gearwheel.

10. The geared positive-displacement machine according to claim 1, wherein the rolling bodies are made of rollers or needle rollers the axes of which are arranged radially with respect to the respective shaft.

11. The geared positive-displacement machine according to claim 1, wherein the rolling bodies are made of spheres.

12. The geared positive-displacement machine according to claim 1, wherein each of the containment bodies have bearings that radially support the axially opposite ends of the shafts.

13. The geared positive-displacement machine according to claim 1, wherein the containment bodies are housed in the housing in an axially movable manner, wherein, when the geared positive-displacement machine is operating, the liquid at the delivery pressure acts on at least one portion of the second face of at least one of the containment bodies in order to generate axial thrusts which bring the containment bodies and the pair of gearwheels close to each other.

14. The geared positive-displacement machine according to claim 1, wherein for each of the first gearwheel and second gearwheel, a respective pair of crowns each made of a plurality of the rolling bodies which are freely housed in a respective annular seat that is coaxial to the respective shaft and that is respectively defined at the interface between the first face of one of the containment bodies and the surface of the first gearwheel or second gearwheel facing it and at the interface between the first face of the other of the containment bodies and the surface of the first gearwheel or second gearwheel facing it.

15. The geared positive-displacement machine according to claim 1, wherein the first gearwheel and the second gearwheel have external toothing.

16. The geared positive-displacement machine according to claim 1, wherein the first gearwheel and the second gearwheel are cylindrical and provided with helical tooth.

17. A geared positive-displacement machine, comprising:

a housing provided with a suction port and with a discharge port;

a pair of gearwheels which are housed and supported by respective shafts for the rotation in a space inside the housing and in fluid communication with the suction port and the discharge port, the pair of gearwheels comprising a first gearwheel and a second gearwheel, wherein the first gearwheel and second gearwheel mesh with each other and are provided with parallel axes, and wherein the first gearwheel is driving and the second gearwheel is driven, the first gearwheel and second gearwheel being cylindrical and provided with helical tooth; and a pair of containment bodies for axially containing the pair of gearwheels, the containment bodies being associated with the housing and each comprising a first face which faces the pair of gearwheels and a second face which is axially opposite to the first face, wherein, for each of the first gearwheel and second gearwheel, the geared positive-displacement machine comprises a plurality of rolling bodies which form a crown and which are freely housed in an annular seat that is coaxial to the respective shaft and that is defined at the interface between the first face of at least one of the containment bodies and the surface of the first gearwheel or second gearwheel facing it, respectively in the first face of at least one of the containment bodies or in the surface of the first gearwheel or second gearwheel facing the first face, wherein the rolling bodies rest on rolling tracks respectively integral with the first gearwheel and second gearwheel and with the at least one containment body, when between the first face of the at least one containment body and the surface of the wheels facing the first face a distance greater than zero exists; and wherein the containment bodies are housed in the housing in an axially movable manner, wherein, when the geared positive-displacement machine is operating, the liquid at the delivery pressure acts on at least one portion of the second face of at least one of the containment bodies in order to generate axial thrusts which bring the containment bodies and the pair of gearwheels close to each other.

18. The geared positive-displacement machine according to claim 17, wherein the rolling bodies, when the geared positive-displacement machine is in the operating conditions, are for supporting axial thrusts which generate between the pair of gearwheels and the at least one containment body.

19. The geared positive-displacement machine according to claim 17, wherein the distance is in the order of the thickness of the hydrodynamic film or meatus of liquid which generates at the interface and which supports the axial thrusts during the operation of the geared positive-displacement machine.

20. The geared positive-displacement machine according to claim 17, wherein the distance is of the order of minimum 1 micron and of maximum some tens of microns, up to a maximum of 100 microns.

* * * * *